United States Patent [19]

Luthman

[11] 3,958,525

[45] May 25, 1976

[54] ARRANGEMENT FOR SERVO-CONTROLLED ADJUSTMENT AND TURNING OF AN OUTBOARD DRIVE

[75] Inventor: Lars Gunnar Valter Luthman, Tullinge, Sweden

[73] Assignee: Saab-Scania Aktiebolag, Sodertalje, Sweden

[22] Filed: Apr. 17, 1975

[21] Appl. No.: 568,839

[30] Foreign Application Priority Data

Apr. 22, 1974 Sweden .....7405397

[52] U.S. Cl. ..... 115/41 R

[51] Int. Cl.² ..... B63H 5/13

[58] Field of Search ..... 115/41, 34 R, 35; 74/816

[56] References Cited

UNITED STATES PATENTS

| | | | |
|---|---|---|---|
| 2,389,668 | 11/1945 | Johnson | 74/816 |
| 3,238,914 | 3/1966 | Swallow | 115/41 R X |
| 3,240,452 | 3/1966 | Cheeseboro | 115/41 HT X |
| 3,722,455 | 3/1973 | Carpenter | 115/41 HT |

*Primary Examiner*—Trygve M. Blix
*Assistant Examiner*—Sherman D. Basinger
*Attorney, Agent, or Firm*—Cushman, Darby & Cushman

[57] ABSTRACT

In a propelling unit for boats there is an inboard drive motor which via a connection through the stern board of the boat transmits torque to a propeller unit in an outboard drive. The outboard drive is movable relative to the drive motor by means of a worm gear, which is manoeuvered via a servo unit which cooperates with a retainer for selectively locking the position of the outboard drive.

7 Claims, 5 Drawing Figures

ARRANGEMENT FOR SERVO-CONTROLLED ADJUSTMENT AND TURNING OF AN OUTBOARD DRIVE

Figure 1:
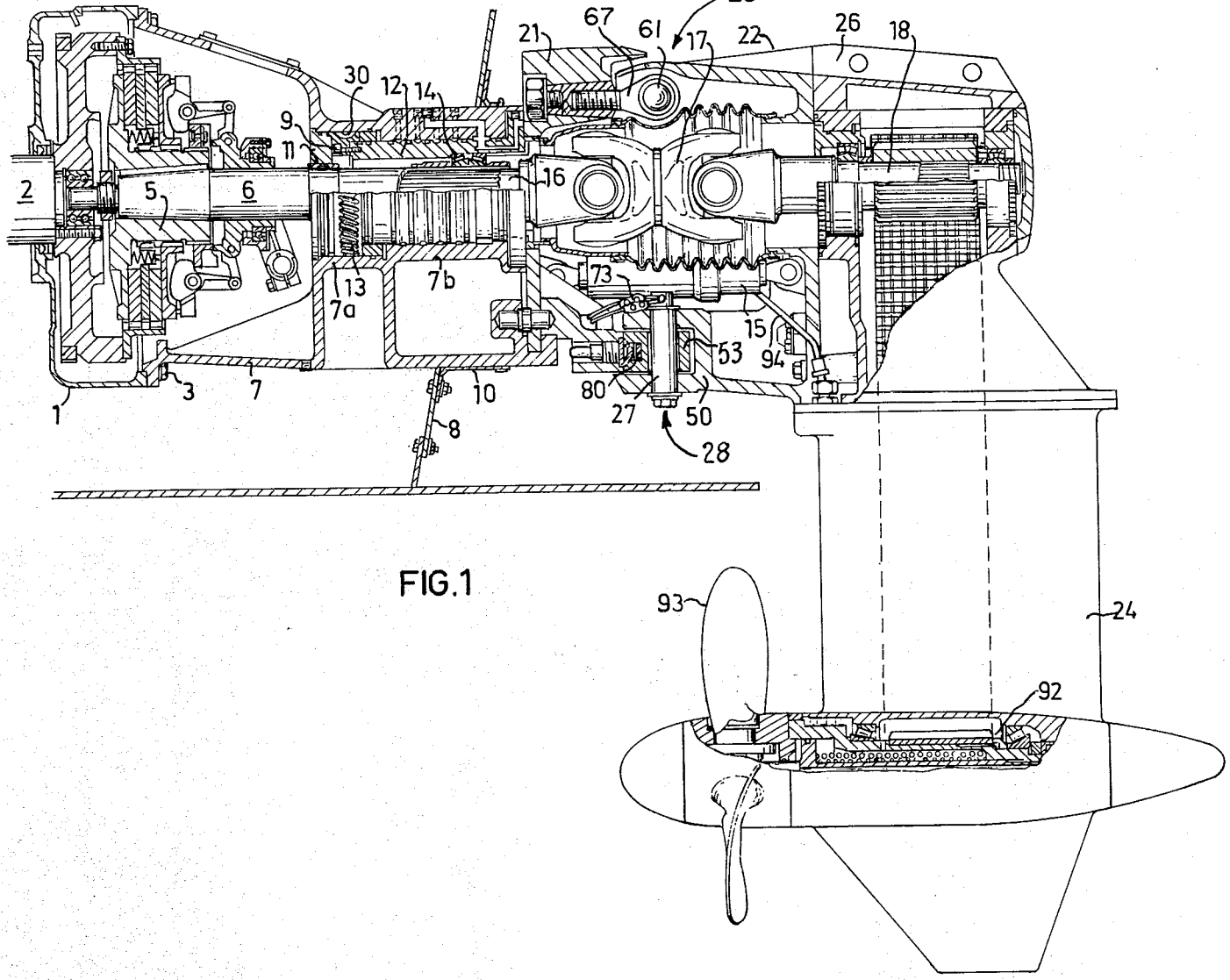

The present invention is related to an arrangement for servo-controlled adjustment and turning of an outboard drive in a propelling unit for boats, comprising at least one inboard mounted motor which, via a drive shaft coaxial with the motor shaft and a mechanical transmission, transmits torque to a propeller unit in an outboard drive, wherein the outboard drive for steering the boat is turnable around as essentially vertical axis located outside the stern board of the boat and wherein the outboard drive can be turned backwards in the direction of the course of the boat and is adapted to rotate relative to the inboard section of the propelling unit around its drive shaft with the help of a worm gear.

Such outboard units are used to an increasing degree in larger pleasure boats, taxi boats, landing boats and similar transport boats and for landing boats for naval purposes. In addition to the fact that an outboard unit appreciably reduces the initial costs compared with conventional inboard installations in which a propeller shaft below the boat is connected to the engine via a bevel gearing or the like, an outboard unit results in significant advantages from the point of view of handling and manoeuverability.

In order to increase navigability in shallow water and provide for improved service and repair possibilities in boats having outboard units it is known to adapt the outboard drive rotatably journalled around an essentially horizontal axis coaxial with the engine shaft. Lateral rotation thus takes place manually and, in heavier units, with the aid of a worm gear. Aside from the fact that this type of operation is rather time-consuming this kind of adjustment of the outboard drive provides no indication of the exact position of the propeller unit in relation to the bottom plane of the boat. This results in unnecessary risks for grounding and subsequent damage to the propeller.

The purpose of the present invention is to facilitate and ensure the manoeuvering of an outboard drive in propelling units of the type named in the introduction.

The present invention is related to an arrangement which is primarily characterized in that an auxiliary motor or similar servo unit is connected to the worm gear which, in cooperation with a hydraulic retaining mechanism for lateral turnings of the outboard drive in an essentially vertical plane, can be engaged and disengaged by means of a controllable electrical circuit comprising at least one solenoid valve which, upon activation, initiates power transmission from the motor for turning the outboard drive.

The arrangement according to the invention is further characterized in that the turning movements in transmitting power from the auxiliary motor to the outboard drive are adapted to be transmitted to a cammed shaft which influences a number of contacts in electric circuits to guide the disengagement of the auxiliary motor and engagement of the retaining mechanism in certain predetermined angular positions of the outboard drive.

A preferred embodiment of the arrangement according to the invention is characterized in that the auxiliary motor is a hydraulic motor. Additional characterizing features of the arrangement according to the invention will be found in the following specification and claims making reference to the enclosed drawings of an outboard unit exemplifying the invention.

Figure 3:
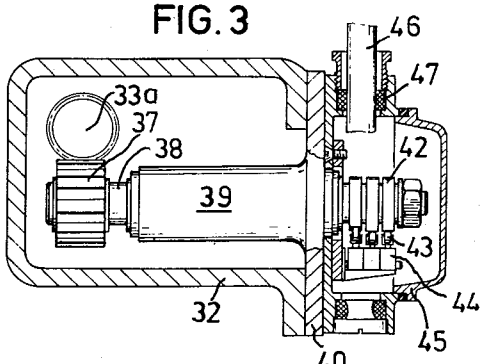
Figure 4:
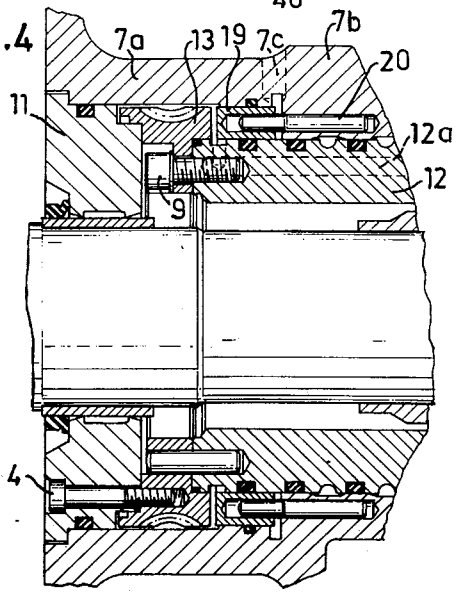
Figure 2:
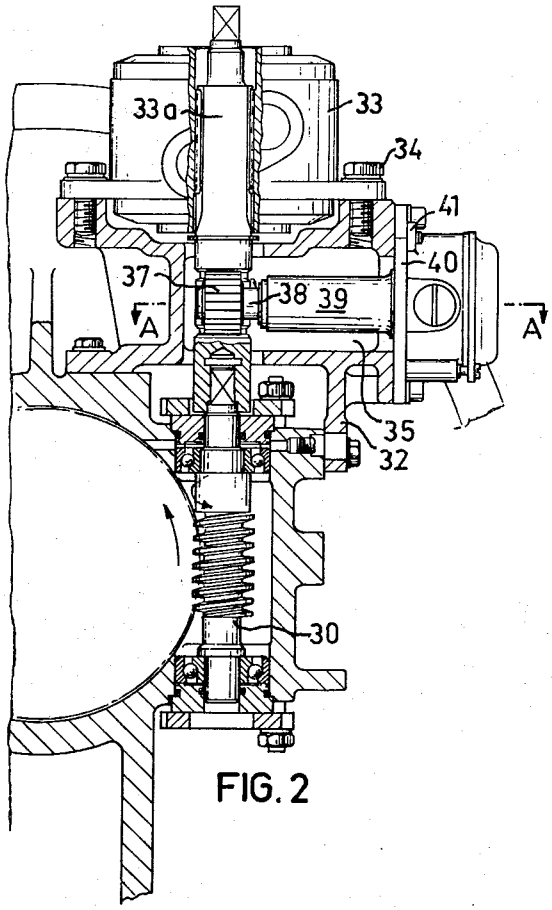
Figure 5:
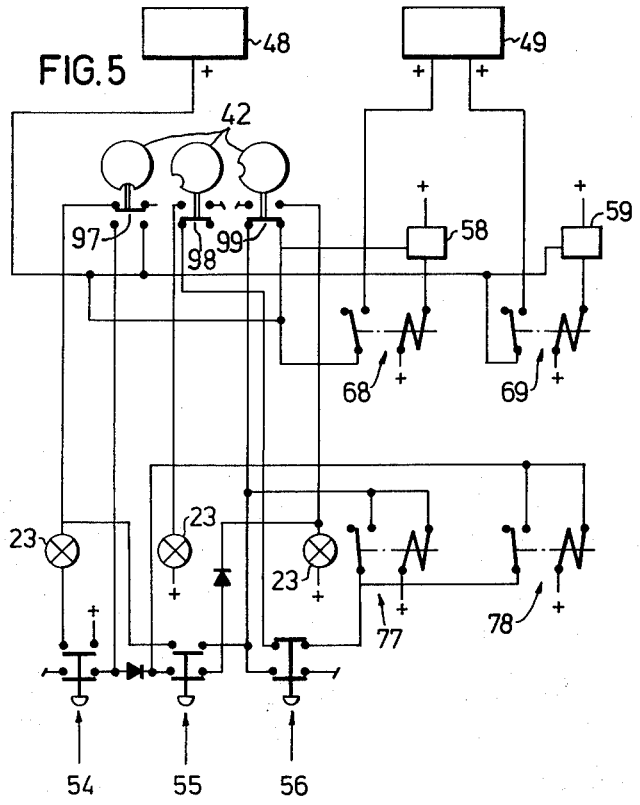

In the attached drawings,

FIG. 1 shows a longitudinal section of the propelling unit according to the invention connected to an inboard diesel motor, FIG. 2 is a longitudinal section of the means which control the lateral turning of the outboard section of the propelling unit, FIG. 3 is a section along the line A—A in FIG. 2 of a rotation-sensing device, FIG. 4 is a longitudinal section in expanded scale of a hydraulic retaining mechanism and FIG. 5 is a block diagram of the electro mechanical means which control lateral turning of the outboard section.

With respect to characteristic functions, the outboard drive arrangement according to the invention may be described as comprising an inboard section and an outboard section. The inboard section is firmly attached to a drive engine, more precisely to the flywheel housing 1 of a diesel motor, by means of flange guides and bolted joints. The driving motor is elastically mounted by conventional means in an engine bed in the stern section of a boat.

Between the output shaft 2 of the drive motor and an input shaft 6 of the outboard drive is provided a friction clutch 5 which, by alternate engagement and disengagement, controls the connection between the shaft 6 and the engine. The function of the clutch is well known and its internal parts are therefore excluded from detailed description.

The clutch 5 is enclosed in a clutch housing 7 which also constitutes the external cap for the inboard section of the outboard drive unit. The clutch housing 7 is firmly attached, by means of the previously mentioned flange guides and a number of bolted joints 3, to the flywheel housing 1 of the motor which flywheel housing is thereby adapted to support the outboard drive unit as a whole. Beginning with the flanged contact surface against the flywheel housing 1, the clutch housing 7 is first conical and then merges into a sleeve shaped section **7*a*, an extension of which merges into a cylindrical envelope surface 7*b* which is eccentric with the sleeve section 7*a*, said cylindrical surface being adapted to pass through a clearance hole in the stern board 8 of the boat. The hole in the stern board 8 is sealed with an elastic sealing ring 10 which is secured to the stern board and encloses the cylindrical envelope surface 7*b***.

Rotatably mounted in the sleeve section **7*a*, in accordance with FIG. 4, is a unit held together with axial bolts 4,9 and consisting of two hubs 11,12 engaging both sides of a worm gear 13. Two conical roller bearings 14 are firmly mounted in the hub 12, which bearings together comprise the journalling of the input shaft 6 in the sleeve section. A hydraulic retaining mechanism for the worm gear 13 is fitted between the hub 12 and the sleeve section 7*a*. The retaining mechanism comprises a retaining disc 19 mounted between the hub 12 and the sleeve section 7*a* which disc is non-rotatably connected by means of a number of guide pins 20 to the sleeve section 7*b*, but which under the influence of hydraulic pressure is displaceable in relation to said section. One side of the retaining disc 19 shows a number of cogs which engage spaces on the worm gear 13 when the retaining disc 19 is pressed into contact with the worm gear 13 and locks said gear in position. The retaining disc 19 acts as a hydraulic piston in a cylinder space formed by the hub 12 and the sleeve section 7***a*, the end walls of said space being limited by the sleeve section 7*b* and the worm gear 13. Upon locking of the worm gear 13, hydraulic fluid is via a passage 7*c* in the sleeve section 7*a* introduced into the cylinder space on the obstruction-free side of the retaining disc 19, and upon releasing the worm gear 13, hydraulic fluid is via a passage 12*a* in the hub 12 introduced into the cylinder space on the cogged side of the retaining disc. The function of the retaining mechanism will be further described in connection with a comprehensive functional description of the arrangement according to the invention.

A shaft 16 is by means of splines displaceably mounted in the end of the input shaft 6 which is located in the sleeve section 7*b* and is in turn via a double universal joint 17 non-rotatably connected to an external drive shaft 18 in the outboard section, said drive shaft being rotatably mounted in an extension of said other shafts.

The hub 12 in the inboard section of the outboard unit has an external flange to which a front casing 21 of the outboard section of the unit is connected by flange guides and by bolts (not shown). The entire outboard section of the unit is rotatably mounted relative to the inboard clutch housing 7 secured to the engine. To this end a transverse worm 30 (see FIG. 2) is rigidly secured with rotatably mounting in the sleeve 7*a* of the clutch housing, which worm engages the worm gear 13 along a secant. The worm 30 extends vertically upward and is connected by means of splines to a coaxial shaft 33*a* in a hydraulic motor 33 of the radial piston type. The shaft 33*a* passes through a bearing bracket 32 which is rigidly connected to the sleeve 7*a* and to which the hydraulic motor 33 is mounted by a number of bolts 34. The hydraulic motor 33 is driven by a hydraulic pump (not shown) mounted on a diesel motor, the flow from said pump being controllable by means of a solenoid valve which is electrically controlled from the operating console of the driver in a manner to be subsequently described. Upon activation torque is transmitted from the hydraulic motor 33 to the worm 30 which in turn influences the worm gear 13 and the hub unit 11,12 joined thereto to turn the outboard section laterally. The bearing bracket 32 comprises an open chamber 35 in which a part of the shaft 33*a* is cogged and engages a cog wheel 37 which is mounted on a shaft 38 which crosses the shaft 33*a* and the cog wheel 37 at right angles. The shaft 38 is mounted in a sleeve 39 fitted with a flange 40 which is secured, with a number of bolts 41 to the bearing bracket 32. As will be seen from FIG. 3 three cams 42 are affixed to the shaft 38 on the outside of the bearing bracket 32. Each cam 42 is engaged by a cam position sensing, spring-loaded contact roller 43 in a micro switch 44. The three micro switches 44 are attached on the outside of the bearing bracket 32 and are influenced by changes in position of the contact rollers 43 to break and make electrical circuits. The cam-fitted shaft end 38,42 and the micro switches 44 are enclosed in a housing 45 affixed to the flange 40 on the sleeve 39. Said micro switches 44 are connected with electrical leads 46 which pass through a hole 47 in the housing 45. The angular position of the contact rollers 43 in relation to the shaft 38 may be adjusted as needed.

The front casing 21 supports a control housing 22 comprising the control means of the outboard section which means are essentially a steering mechanism 28, a rear casing 26 having power transmission means and a propeller unit 24. The control housing 22 is adapted for various types of turning movements relative to the front casing 21 which movements are determined in part by the steering action of the propelling unit and in part by safety considerations for the prevention of extensive damage to the propeller unit 24 in the event of grounding. A vertical shaft 27 and a ball joint 29 comprise, in this case, a lower and upper connecting member between the two casings 21,22.

As may be seen in FIG. 1 the vertical shaft 27 is mounted between two arms in a lower U-shaped bearing bracket 50 in the control housing 22. Between the arms the shaft 27 is rotatably mounted in a bearing mounting 53 secured at the front casing 21 by two bolts not shown whereby the control housing 22 is rotatable in the horizontal plane relative to the front casing 21.

The upper connecting member, the ball joint 29, comprises a ball 61 which is attached in the rear casing 26. The ball 61 cooperates with a carrier 67 mounted in the front casing 21 which carrier with a bearing (not shown) mounted therein contains the ball and by means of rotatably mounting forms a so-called universal joint for the outboard section.

Steel reinforced hydraulic lines one of which is shown at 94 are led from the front casing 21 to the propeller unit 24 for conveying pressure medium to the adjustment mechanism 92 for setting the propeller blades 93. The hydraulic lines 94,95 connect at the upper section of the propeller unit 24 with channels cast therein (not shown) which thereafter convey the pressure medium down to the adjustment mechanism 92 for the propeller blades 93.

Steering of the boat is effected by means of horizontal turnings of the outboard drive around the vertical shaft 27 and is carried out with the help of two hydraulic cylinders 15 of which only one is shown in FIG. 1. The hydraulic cylinders are situated on opposite sides of the longitudinal axis of symmetry of the outboard drive in a horizontal plane. The hydraulic cylinders 15 and their respective piston rods are pivotably mounted in the front casing 21 and control casing 22, respectively. Since said steering action is of limited importance in connection with the invention details included therein are omitted from the description which follows.

Three switches 54,55,56 are provided on the operator console (not shown) for setting the angular positions of the outboard drive. Two of the switches 54,55 on being switched in close two contacts each while the third switch 56 on being switched in opens one contact and closes one. The switches automatically spring back to the initial position when pressure is released.

On switching in any one of the switches 54,55,56 a solenoid valve 48 for engaging and disengaging the hydraulic retaining mechanism 19,20 is activated and a solenoid valve 49 for engaging and disengaging the hydraulic motor 33 is activated. The latter activation occurs, however, with a certain time delay under the influence of either of two timing circuits 58,59 which each influences a relay 68,69 to switch on the lead in question to the solenoid valve 49. Which of the timing circuits 58,59 and which of the relays 68,69 connected thereto is engaged depends on the angular position of the outboard drive. The timing circuits 58,59 are of known construction and will not be described in detail in this context.

Upon switching in the switch 55, one of two relays 77,78, depending on the position of the outboard drive, is activated. All of the relays 68,69,77,78 are typified by a coil which on activation influences an armature (not shown) to open and close a contact. Switching the switch 55 in this fashion entails that the solenoid valves 48,49 are kept activated with the help of the relays 77,78 even after the switch 55 is returned to its initial position and until the outboard drive has reached the angular position predetermined by the appropriate cam 42. This type of attitude retention does not occur when switching in the switches 54,56. The result is that turning movements of the outboard drive may be terminated by returning the appropriate switch 54,56 to its initial position.

The outboard drive is adapted to have a normal driving position in a vertically downwards direction and a service position above the water line in essentially a vertically upwards direction. In shallow water, however, it is desirable to set the outboard drive in a driving position on a level with the bottom plane of the boat, a so-called intermediate position. The three positions comprise the three previously mentioned predetermined angular positions which are controlled by the cams 42. Upon switching in either of the switches 54,56 however, the outboard drive can be set in an optional angular position by returning the switch in question to its initial position.

In the switching configuration shown in FIG. 5 the outboard drive is in the normal driving position. If a turning of the outboard drive to the intermediate position is desired the switch 55 is depressed, whereby a circuit containing the coil in the relay 77, one of the contacts in the switch 55 and the upper contact of the switch 97 is closed. Activating the relay 77 also closes a circuit comprising one of the contacts in the switch 56 and the lower contact in the switch 98. The relay 77 thereby remains the drawn position, even after the switch 55 has sprung back. In this position current is fed through the solenoid valve 48 via the lower contact in the switch 99, the switch 56, the relay 77 and the lower contact in the switch 98. The solenoid valve is thereby switched over and the hydraulic pressure on the retaining mechanism 19,20 ceases so that a turning of the outboard drive can be effected. When the relay 77 is activated current is also fed to the relay 68 via the timing circuit 58. When the relay 68 is activated current is fed through the solenoid valve 49, which valve is then switched over so that the hydraulic motor 33 receives pressure and starts the turning. The solenoid valves 48 and 49 do not, as mentioned previously, receive current simultaneously. Instead, because of the time delay circuit 58, current is supplied to the solenoid valve 49 somewhat later than to the solenoid valve 48. In this way the retaining mechanism 19,20 is able to disengage before the hydraulic motor 33 starts.

Turning the outboard drive from its normal driving position causes the switch 97 to switch over from its upper position to its lower position which does not, however, interrupt the flow of current through the solenoid valves 48,49. When the outboard drive has been turned to its intermediate position the cam 42 causes the switch 98 to be switched over from its lower to its upper position whereby the thus far closed lower contact opens. This means that the solenoid valves 48,49 no longer receive current and will thus switch over to their inactive position. At that point supply of hydraulic pressure to the hydraulic motor 33 ceases and the motor stops operating. In addition hydraulic pressure is supplied to the latching mechanism 19,20 which locks the outboard drive in the intermediate position. When the switch 98 takes on its upper position the upper contact is closed and current flows to the indicator light 23 which is then lit.

To initiate turning of the outboard drive to the intermediate position from the service position the relay 78 is activated upon switching in the switch 55 in a manner corresponding to that described above for the relay 77. Selfholding of the relay 78 is effected by current flow via the switch 56 and the switch 98. Because the lower contact of the switch 97 is then closed, current is fed through the solenoid valve 48 and via the relay 69, which is activated with a certain delay by the timing circuit 59, also through the solenoid valve 49. The hydraulic motor 33 then starts the turning of the outboard drive to the intermediate position.

To initiate turning of the outboard drive to the service position from one of the two other positions the switch 56 is depressed. One of its contacts is then closed and via the lower contact in the switch 99 current is fed through the solenoid valves 48,49 in accordance with the description above. The hydraulic motor effects turning of the outboard drive as long as the switch 56 is depressed or until the cam 42 influences the switch 99 to adopt its upper position. In both cases the flow of current is broken by the solenoid valves 48,49 so that they return to their inactivated state, which implies that the hydraulic motor 33 stops and that the retaining mechanism 19,20 locks the outboard drive in the predetermined position. If the turning has proceeded to the service position the switch 99 assumes its upper position, whereby the indicator light 23 receives current and is lit.

To initiate turning of the outboard drive back to the normal driving position from one of the two other positions the switch 99 is kept depressed. Current is thereby fed through the switch 54, the switch 97 and the solenoid valves 48,49. Since the direction of turning in this case is opposite to that which prevails during turning to the service position, the flow of current takes place through the solenoid valve 49 via the timing circuit 59 and the relay 69. The turning continues as long as the switch 54 is depressed or until the cam 42 has switched over the switch 97 to its upper position. In both cases the flow of current is broken analogous to the above so that the hydraulic motor 33 stops and the retaining mechanism 19,20 locks the outboard drive in its existing position. The indicator light 23 for the normal driving position is lit only on the condition that the switch 97 assumes its upper position and that the switch 54 is depressed. In the circuit diagram according to FIG. 5 are included two diodes which, upon depression of the switches 54 and 55, prevent undesirable current flow through the relay 78 and through the indicator light 23 for the service position.

Upon turning of the outboard drive initiated by the switches 54,55,56, the solenoid valves 48,49 are accordingly activated in accordance with the above description. This causes the hydraulic retaining mechanism 19,20 to be disengaged and the hydraulic motor 33 to be engaged. Power transmission to the outboard section of the propeller unit is effected via the worm gear 13,30 and the hub 12, said hub being turned about the drive shaft 6. The turning movement in the screw 30 is also transmitted to the cammed shaft 38. When one of the contact rollers 43 bearing on the cams 42 breaks a current circuit the two solenoid valves 48,49 are switched over, whereby the hydraulic motor 33 is disengaged and the retaining mechanism 19,20 is engaged.

What I claim is:

1. In a drive system for a boat: an outboard propeller unit; power transmitting means for transmitting power from an inboard engine to the propeller unit, said means including an inboard section, an outboard section which is mounted for rotation relative to the inboard section about a fore-and-aft axis of the boat, and shaft means extending through said sections; a power-operated auxiliary motor and a drive connection between said motor and the outboard section for rotating the latter about said axis; adjustable retaining means engageable and disengageable with said drive connection for selectively latching said drive connection in any of several preselected positions so as to latch said outboard section in corresponding rotative positions relative to said inboard section; control means responsive to the rotative position of said outboard section for activating and deactivating said auxiliary motor and for engaging and disengaging said retaining means with said drive connection.

2. A drive system as in claim 1 wherein said inboard section of said power transmitting means includes a stationary housing; wherein said drive connection between said auxiliary motor and said outboard section of the power transmitting means includes a worm wheel connected to said outboard section so as to rotate therewith; and wherein said adjustable retaining means includes an annular disc coaxial with said worm wheel, means non-rotatably connecting said disc to said housing and hydraulic means for moving said disc axially into and out of engagement with said worm wheel.

3. A drive system as in claim 2 wherein hydraulic means includes one side of said disc forms a wall of a first chamber and wherein the other side of the disc forms a wall of another chamber whereby hydraulic fluid may be introduced and withdrawn from said chambers to effect said axial movement of said disc.

4. A drive system as in claim 1 wherein said drive connection between said auxiliary motor and said outboard section of the power transmitting means includes a worm wheel surrounding said shaft means and rotatable relative thereto, means connecting said worm wheel and said outboard section for rotation with each other and a worm which is rotatably driven by said auxiliary motor and which drivingly engages said worm wheel, and wherein said adjustable retaining means includes an annular disc surrounding said shaft means and adjustable axially thereof into and out of engagement with said worm wheel, said retaining means further including means fixing said annular disc against rotation about the axis of said worm wheel.

5. A drive system as in claim 1 wherein said control means includes hydraulic means for engaging and disengaging said retaining means with said drive connection, electrical circuits controlling said hydraulic means and said motor, a cammed shaft rotatable upon operation of said motor and electrical switches in said circuits operated by said cammed shaft.

6. A drive system as in claim 5 wherein said inboard section of said power transmitting means includes a stationary housing; wherein said drive connection between said auxiliary motor and said outboard section of the power transmitting means includes a worm wheel connected to said outboard section so as to rotate therewith; and wherein said adjustable retaining means includes an annular disc coaxial with said worm wheel, means non-rotatably connecting said disc to said housing and hydraulic means for moving said disc axially into and out of engagement with said worm wheel.

7. A drive system as in claim 6 wherein said auxiliary motor is a hydraulic motor and wherein said control means for said motor and for said retaining means includes a first solenoid valve for activating said motor and a second solenoid valve for disengaging said retaining means from said drive connection and timing means for activating said motor after disengagement of said retaining means.

* * * * *